United States Patent [19]

Stekly

[11] 4,213,854

[45] Jul. 22, 1980

[54] MAGNETIC SEPARATING APPARATUS WITH MAGNETIC SHIELDING MEANS

[76] Inventor: Zdenek J. J. Stekly, Hampshire Ct., Wayland, Mass. 01778

[21] Appl. No.: 881,810

[22] Filed: Feb. 27, 1978

[51] Int. Cl.[2] ..... B03C 1/10

[52] U.S. Cl. ..... 209/223 R; 209/217; 209/232

[58] Field of Search ..... 209/217, 223 R, 214, 209/39, 232; 210/213, 222, 223, 228; 335/301

[56] References Cited

U.S. PATENT DOCUMENTS

| | | | |
|---|---|---|---|
| 2,974,981 | 3/1961 | Vervest | 210/222 X |
| 3,437,963 | 8/1969 | Gang | 335/301 X |
| 3,721,929 | 3/1973 | Gabriel | 335/301 X |
| 4,054,513 | 10/1977 | Windle | 209/214 |

FOREIGN PATENT DOCUMENTS

| | | | |
|---|---|---|---|
| 204643 | 11/1956 | Australia | 335/301 |
| 2615581 | 10/1976 | Fed. Rep. of Germany | 209/232 |
| 2634726 | 7/1977 | Fed. Rep. of Germany | 210/222 |

*Primary Examiner*—Robert Halper
*Attorney, Agent, or Firm*—Weingram & Klauber

[57] ABSTRACT

Magnetic separating apparatus is disclosed which includes means for establishing a magnetic field in a predetermined zone, a separating chamber having an inlet and an outlet for fluid, fluid-permeable and magnetizable material disposed within the separating chamber, ferromagnetic shielding means for magnetically screening a zone remote from the predetermined zone; and means for moving the separating chamber between the predetermined zone and the remote zone. When within one of the remote zones, a separating chamber is screened from the magnetic field applied by the magnet within the predetermined zone, and thus the packing material within the separating chamber may be particularly efficiently regenerated within this zone. This regeneration may e.g. be carried out by passing clean water through the packing material, optionally after having demagnetized the packing material, in order to flush out magnetizable particles from collecting sites within the packing material.

8 Claims, 7 Drawing Figures

MAGNETIC SEPARATING APPARATUS WITH MAGNETIC SHIELDING MEANS

This invention relates to a magnetic separator.

According to one aspect of the present invention, there is provided a magnetic separator comprising:

(i) a magnet for establishing a magnetic field in a predetermined zone;

(ii) a separating chamber having an inlet and an outlet for fluid;

(iii) fluid-permeable and magnetisable material disposed within the separating chamber;

(iv) a ferromagnetic shield for magnetically screening a zone remote from the predetermined zone; and (v) means for moving the separating chamber between the predetermined zone and the remote zone.

Such an arrangement may be used with advantage in the apparatus described in the present co-assignee's U.S. Pat. No. 4,054,513 to William Windle.

According to another aspect of the present invention there is provided a magnetic separator comprising:

(a) a magnet for establishing a magnetic field in a predetermined zone;

(b) two or more separating chambers coupled together to form a train, each separating chamber being provided with an inlet and at least one outlet for fluid;

(c) fluid-permeable and magnetisable material disposed in each separating chamber;

(d) one or more ferromagnetic shields for magnetically screening one or more zones remote from the predetermined zone; and (e) means for moving the train between (i) a first position in which one of the separating chambers is within the predetermined zone and another separating chamber is within (one of) the remote zone(s), and (ii) a second position in which said another separating chamber is within the predetermined zone and the one separating chamber is within (one of) the remote zone(s).

In a preferred embodiment there are two separting chambers and two shields and the moving means is adapted to move the train reciprocatingly between the first position in which the other separating chamber is within a first remote zone screened by a first shield and the second position in which the one separating chamber is within a second remote zone screened by a second shield.

Preferably the separating chambers include ferromagnetic walls which serve to assist magnetic screening of the separating chambers when the separating chamber are within the remote zone(s).

According to one embodiment (each of) the shield(s) is in the form of a hollow cylinder of circular cross-section surrounding the (associated) remote zone and each of the ferromagnetic walls is in the form of a circular disc which at least partially closes off an end of (one of) the shields(s) when the associated separating chamber is within the remote zone surrounded by that shield. In this case each separating chamber is preferably also in the form of a cylinder of circular cross-section of slightly smaller diameter than the shield(s). In a preferred form of this embodiment, there are two ferromagnetic walls associated with each separating chamber, one of which walls is attached to one of the end walls of the separating chamber and the other of which walls is attached to the other end wall of the separating chamber.

When within (one of) the remote zone(s), a separating chamber is screened from the magnetic field applied by the magnet within the predetermined zone and thus the packing material within the separating chamber may be particularly efficiently regenerated within this zone. This regeneration may be carried out by passing clean water through the packing material, optionally after having demagnetised the packing material, in order to flush out magnetisable particles from collecting sites within the packing material. In fact demagnetisation which was previously essential for efficient regeneration may be dispensed with entirely.

In order that the present invention may be more fully understood, an embodiment of a magnetic separator according to the present invention will now be described, by way of example, with reference to the accompanying drawings, in which.

Figure 1:
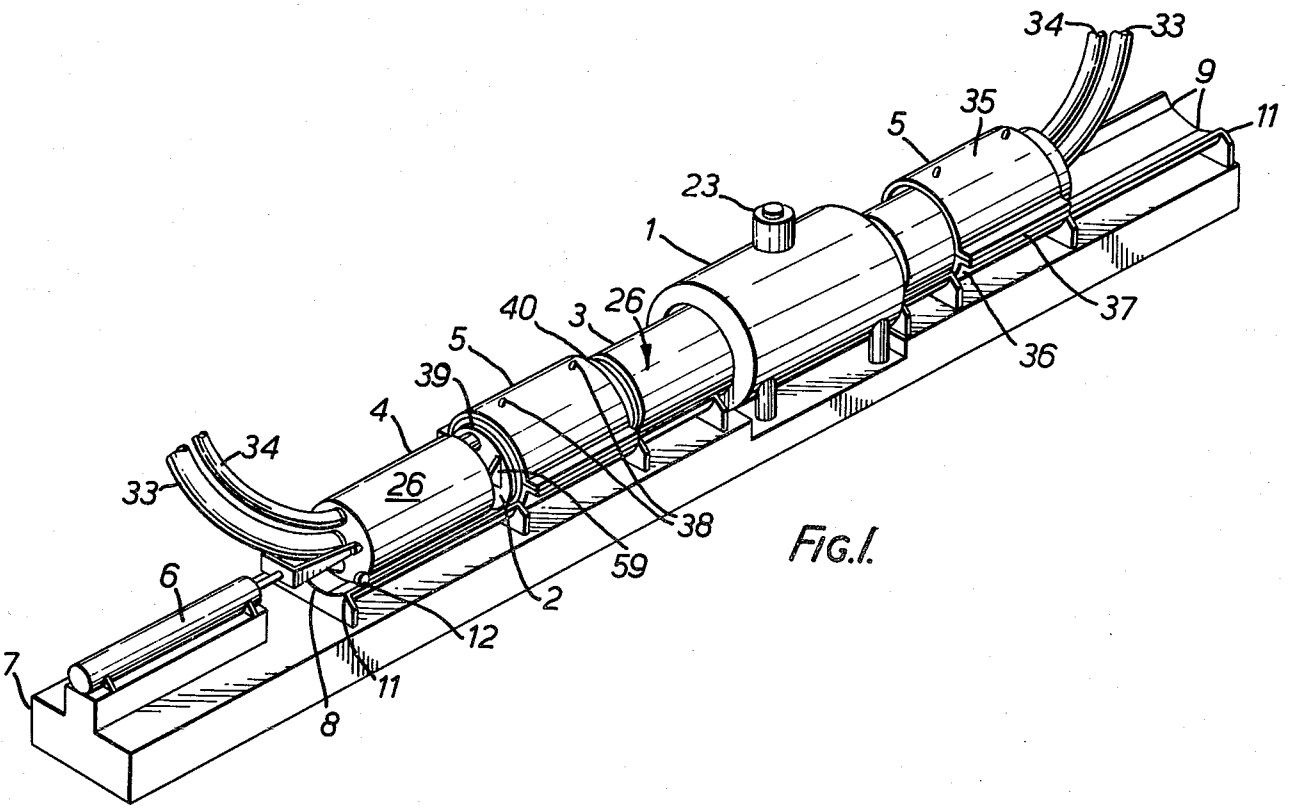
FIG. 1 is a perspective view of this embodiment.
Figure 2:
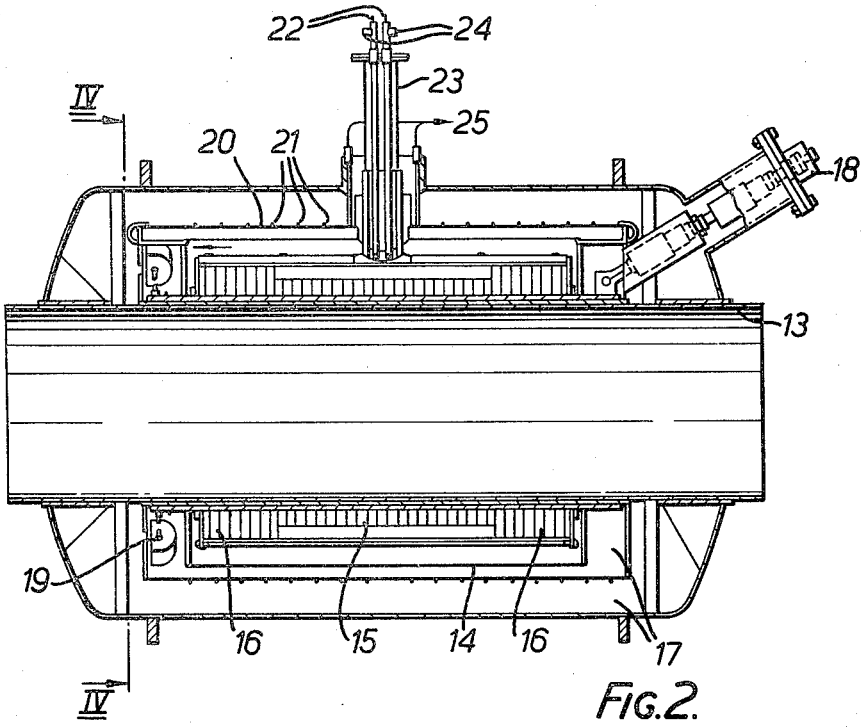
FIG. 2 is a longitudinal sectional view through a superconducting electromagnet forming part of this embodiment.
Figure 3:
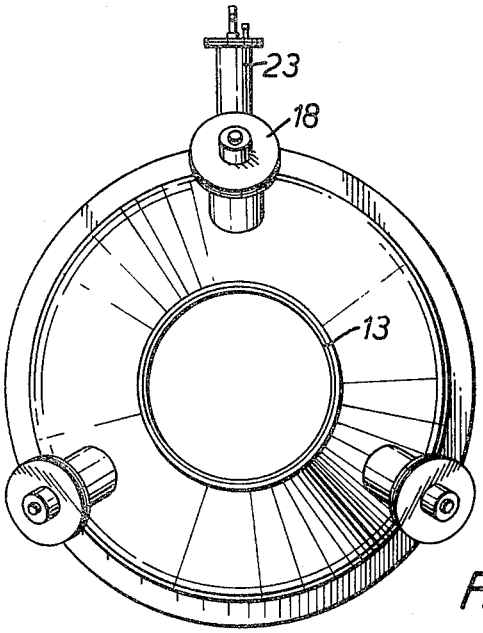
FIG. 3 is an end view of the superconducting electromagnet from the right as shown in FIG. 2.
Figure 4:
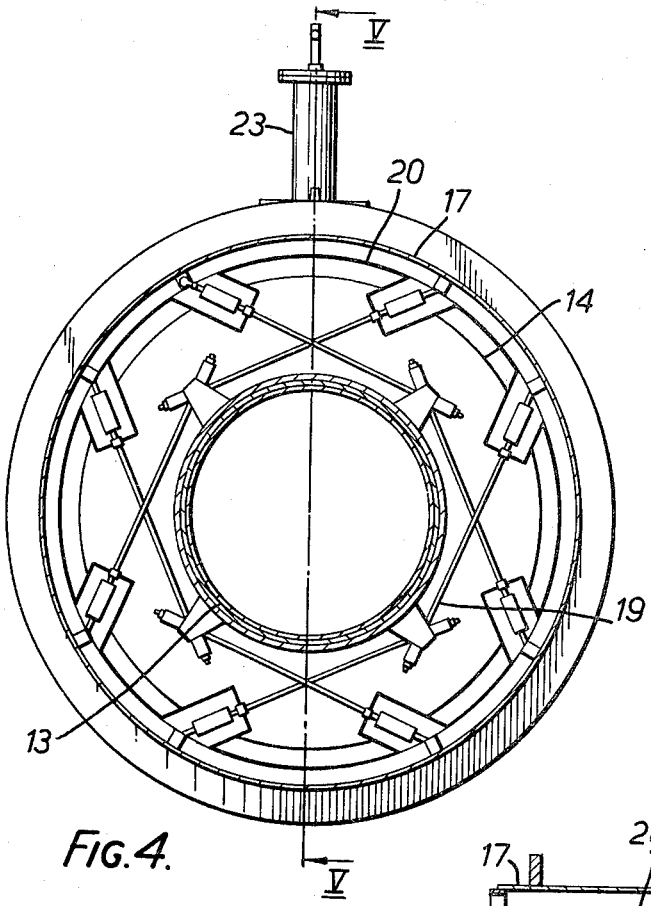
FIG. 4 is a cross-sectional view through the superconducting electromagnet taken along the line IV—IV in FIG. 2.
Figure 5:
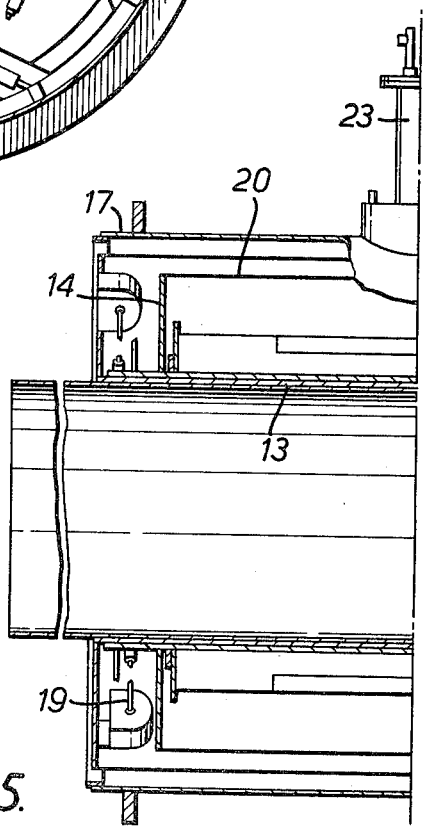
FIG. 5 is a sectional view of part of the superconducting electromagnet taken along the line V—V in FIG. 4.

Referring to FIG. 1, the magnetic separator illustrated therein comprises a superconducting electromagnet 1, two separating chambers 2, a central compensating element 3, two outer compensating elements 4, two ferromagnetic cylindrical shields 5, moving means in the form of a hydraulic ram 6, and a concrete base 7.

The moving means may also be a pneumatic ram or a mechanical device such as a rack and pinion system. The two separating chambers and the three compensating elements are articulated together to form a train of elements which can be reciprocated by means of the hydraulic ram 6 between a first position in which the first separating chamber is within the bore of the electromagnet 1 and the second separating chamber is within the first ferromagnetic shield, and a second position in which the second separating chamber is within the bore of the electromagnet 1 and the first separating chamber is within the second ferromagnetic shield. In operation a magnetic field is established in a predetermined zone within the bore of the electromagnet 1. The train is supported by an arcuate supporting surface 8 in which are set sliding strips 9 of aluminium-bronze alloy lubricated with oil. Further sliding strips (not shown) are provided along the uppermost part of the bore of the superconducting electromagnet 1 and along the uppermost parts of the bores of the ferromagnetic shields 5.

The sliding strips may also be strips of plastics material which exhibit a low coefficient of sliding friction, but it is preferred to use a porous bearing metal to which oil is supplied. Strips of stainless steel 10 (see FIG. 7) are attached to the outside of the separating chambers 2 and the compensating elements 3, 4 and co-operate with the sliding strips. The end portions of the supporting surface 8 extend upwardly to form guide rails 11 on which run rollers 12 mounted on the outer ends of the outer compensating elements 4 in order to prevent rotation of the train about its longitudinal axis. Each compensating element 3, 4 is an assembly comprising an outer, cylindrical casing 26 and six discs of ferromagnetic material, preferably soft iron, (not shown), the assembly being held together by four threaded longitudinal tie rods (not shown). The outer casing 26 and the tie rods are of non-magnetic material, the casing 26 preferably being made of stainless steel.

The thickness, number and position of the ferromagnetic discs in the compensating elements are chosen to be such that, when a separating chamber containing ferromagnetic packing material is withdrawn from the bore of the electromagnet 1 and a compensating element is drawn into the bore, the force opposing the withdrawal of the separating chamber from the bore is balanced by the force tending to draw the compensating element into the bore.

Referring to FIGS. 2 to 5, the electromagnet 1 comprises a central tube 13 surrounding the bore and an annular vessel 14 for containing liquid helium surrounding the tube 13. The electromagnet 1 further comprises a series of electromagnet coils 15, 16 disposed in the vessel 14 and wound from a superconductor consisting of filaments of niobium titanium alloy surrounded by copper. The coils may also be wound from a superconductor consisting of filaments of aluminium of extremely high purity, a niobium tin alloy or a niobium titanium alloy. The electromagnet coils 16 near the ends of the tube 13 have a greater number of windings than the more central coils 15 in order to compensate for fall-off of magnetic field intensity near the ends. The liquid helium is conveniently supplied by a suitable continuous liquifaction plant. The vessel 14 is suspended within an evacuated vessel 17 having silvered inner walls at one end by means of three substantially rigid struts 18 comprising at least a portion of material of low thermal conductivity arranged in tripod formation and at the other end by means of stainless steel rods 19 which are relatively flexible arranged in the manner of the spokes of a wire wheel in order to accommodate radial and longitudinal expansion and contraction of the vessel 14. This method of suspending the vessel 14 allows for thermal expansion and contraction as the temperature of the vessel 14 is raised or lowered, whilst at the same time minimising the conduction of heat from outside the vessel 17 to the vessel 14. A thermal shield 20 of good conductivity, for example copper, is disposed between the outer wall of the vessel 14 and the inner wall of the evacuated vessel 17 and is cooled to a temperature intermediate that of liquid helium and the outside temperature, preferably in the range from 25° K. to 100° K. Advantageously the shield 20 is cooled to about 50° K. by means of tubes 21 attached to the shield 20 carrying helium vapour boiling off from the liquid helium in the vessel 14. Electrical leads 22 for supplying power to the electromagnet coils 15, 16 pass into the vessel 14 by way of a tube 23 which is also cooled by helium vapour boiling off from the liquid helium, thus minimising conduction of heat down the leads 22. Helium vapour is discharged from outlets 24 and 25 and is returned to a refrigerator for reliquifaction.

Figure 6:
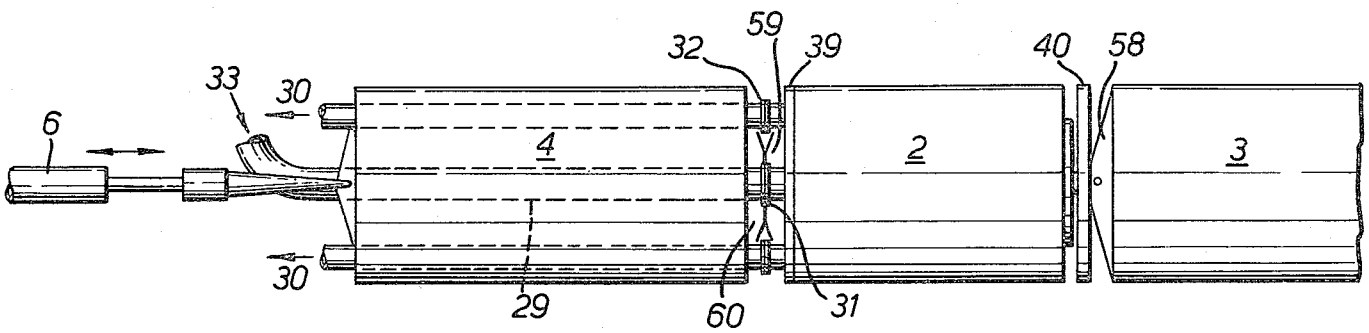
FIG. 6 is a diagram showing the arrangement of various elements of the embodiment.
Figure 7:
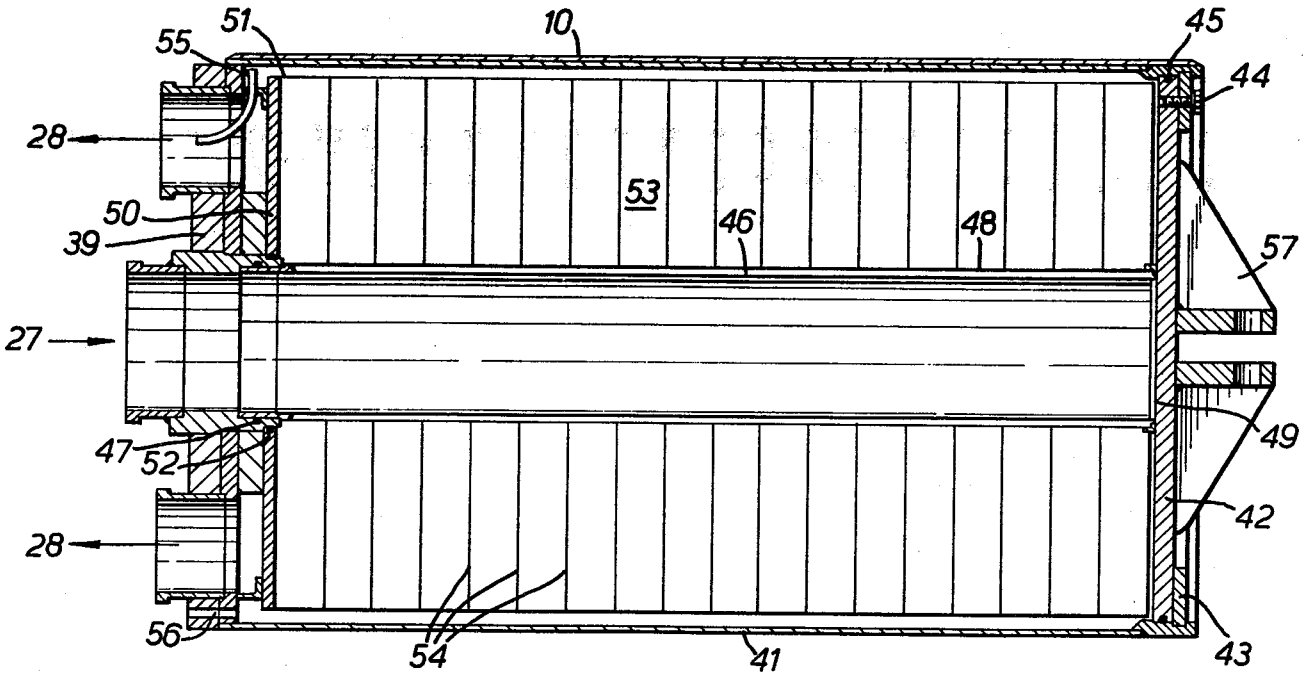
FIG. 7 is a longitudinal sectional view through a separating chamber forming part of this embodiment.

Referring to FIG. 7, each separating chamber 2 is provided with an inlet 27 for feed suspension and two outlets 28 for product suspension which is substantially free of magnetisable material. Referring also to FIG. 6, the inlet 27 is connected to a conduit 29 and each outlet 28 is connected to a respective conduit 30 by means of coupling means 31 and 32 respectively which allow movement of the inlet 27 and the outlets 28 with respect to the conduits 29 and 30. The conduits 29 and 30 pass through the outer compensating element adjacent the separating chamber and are connected respectively to a flexible conduit 33 for feed suspension and a flexible conduit 34 (see FIG. 1) for product suspension. Each separating chamber 2 also comprises a cylindrical casing of circular cross-section and a removable lid 42 which is held firmly in place on the casing 41 by four arcuate locking members 43 which are secured by screws 44. A water-tight O-ring seal 45 is provided between the rim of the lid 42 and the casing 41. The inlet 27 communicates with an apertured tube 46, an O-ring seal 47 being provided between the tube 46 and the inlet 27. A second apertured tube 48 is disposed coaxially around the tube 46, the spacing between the two tubes 46 and 48 being about 5 mm. The holes in the second tube 48 are offset relative to the holes in the tube 46 to force the feed suspension to follow a tortuous path as it passes from within the tube 46 into a ferromagnetic packing material 53 disposed around the tube 48.

The packing material is preferably of the randomly orientated ferromagnetic filament type such as ferromagnetic stainless steel wool. However other types of packing material such as ferromagnetic particles, foam material or filaments packed singly or in bundles may also be used. A rubber gasket 49 is provided on the inside of the lid 42 to seal the open ends of the tubes 46 and 48.

The packing material 53 is contained by the tube 48, the lid 42, an annular end plate 50 surrounding the inlet 27 and a foraminous cylindrical wall 51 coaxial with the tubes 46 and 48.

The foraminous cylindrical wall 51 is separated from the wall of the tube 46 by a distance of from about 1 cm to about 5 cm. A water-tight O-ring seal 52 is provided between the inner edge of the plate 50 and the inlet 27. The chamber containing the packing material 53 is divided up into a plurality of annular compartments by eighteen annular plates 54 which are fixed at the desired spacing by four threaded tie rods (not shown). The annular plates 54 reduce any permanent compression of the packing material caused by repeated movements of the separating chamber into and out of the bore of the electromagnet 1. The packing material is initially packed into the annular compartments so that about 95% of the available volume is void (i.e. not actually filled with steel). In use, feed suspension enters through the inlet 27 and passes through the slotted tubes 46 and 48. It then flows substantially radially through the packing material 53 and passes through the apertures in the wall 51 into the annular space between this wall and the casing 41 and out of the outlets 28. A venturi tube 55 is provided at the uppermost outlet 28 with one end opening near the uppermost part of the separating chamber and the other end opening in the centre of that outlet 28 where the flow velocity of the suspension is high. The function of this venturi tube 55 is to withdraw any air which may collect in the uppermost part of the separating chamber. A drain hole 56 is provided at the lowermost part of the separating chamber to enable the chamber to be completely emptied. With the exception of the packing material all the components of the separating chamber are of non-magnetic material.

Referring again to FIG. 1, each ferromagnetic cylindrical shield 5 which is of slightly greater diameter than each of the separating chambers comprises two semicylindrical halves 35 and 36 having flanges 37 which are bolted together. Furthermore each shield 5 may have a thickness in the range from 25 mm to 50 mm. Lifting eyes 38 are provided on the upper halves to enable them to be removed to facilitate removal and replacement of the compensating elements and separating chambers which make up the train. When a separating chamber is within a cylindrical shield 5, the separating chamber is magnetically screened by this shield as well as by a first soft iron disc 39 of 38 mm thickness attached to the outer end of the separating chamber and a second soft iron disc 40 of the same thickness which forms part of a coupling member (not shown) which connects the separating chamber to the central compensating body 3 (as may be seen more clearly in FIGS. 6 and 7).

Referring to FIGS. 6 and 7, the separating chamber is coupled to the central compensating element 3 by means of a universal joint comprising a clevis 57 which forms part of the lid 42, a pin (not shown) which connects the clevis 57 to the coupling member (not shown) which carries the soft iron disc 40, and a second pin (not shown) at right angles to the first pin which connects the coupling member to a clevis 58 on the central compensating element 3. The separating chamber is coupled to the outer compensating element 4 by means of a clevis 59 which forms part of the casing 41 and which is connected to a clevis 60 on the outer compensating element 4 by a pin (not shown). The articulation of the elements of the train by the system of clevises and pins described above permits any element in the train to be removed and replaced without affecting the other elements of the train. This is especially important when it is desired to replace a separating chamber, the packing material of which has become choked with captured magnetisable particles. The holes in the clevises and the coupling member which receive the connecting pins are provided with resilient bushings to allow for tolerances in manufacture and any slight misalignment of the elements of the train.

The magnetic separator described above with reference to the drawings operates as follows. When the apparatus is operating, a magnetic field is continuously established in the predetermined zone within the bore of the electromagnet 1. The intensity of the magnetic field generated in the bore of the electromagnet 1 may be in the range from 2.5 tesla to 10.0 tesla, but is advantageously about 5 tesla. It is convenient to supply the coils 15, 16 with direct current at a relatively low voltage, for example in the range from 5 to 50 volts and preferably about 15 volts. The coils are preferably energised by increasing the current gradually from zero to a maximum in the range from 500 to 1500 amps. With one of the separating chambers 2 within the predetermined zone and the other separating chamber 2 within the bore of one of the shields 5, feed suspension, for example a clay slurry, is introduced into the one separating chamber by way of the inlet 27. This feed suspension passes into the packing material 53 after following a tortuous path in passing through the tubes 46 and 48. The packing material 53 has been magnetised by the magnetic field and thus magnetisable particles in the feed suspension are magnetised and attracted to the magnetisable material 53 as the feed suspension passes radially through the magnetisable material 53. The product suspension which is substantially free of magnetisable particles passes out of the separating chamber via the outlets 28. Optionally clean water is then passed through the separating chamber from the inlet to the outlets to flush out any substantially non-magnetisable particles which may have become mechanically entrained in the packing material. The hydraulic ram 6 is then actuated to move the train into a position in which the one separating chamber is within the bore of the other shield 5 and the other separating chamber is within the predetermined zone. Feed suspension is then passed through the other separating chamber in the same way as feed suspension was passed through said one separating chamber. Simultaneously the packing material of the one separating chamber within the bore of the other shield 5 may be regenerated, for example by rinsing the magnetisable particles out of the packing material with clean water optionally after having demagnetised the packing material. During this regeneration operation the separating chamber is shielded from the magnetic field applied by the electromagnet 1 by the shield 5 and the soft iron discs 39 and 40. Finally the train is moved back to its original position with the one separating chamber within the predetermined zone and the other separating chamber within the bore of the one shield 5. The packing material of the other separating chamber may then be regenerated while further feed suspension is supplied to the one separating chamber. This separation cycle may be repeated many times with the magnetic field continuously applied.

The magnetic separator described above is a wet magnetic separator and is suitable for a wide range of separations in the mineral and chemical industries. It is especially adapted for separating magnetisable impurities from kaolinitic clays.

The annular plates 54 are spaced apart by pointed pins (not shown) provided on on face of each of the plates 54, which pins extend into holes in the opposite face of an adjacent plate 54. Some of the pins are hollow in order that they may accommodate the tie rods. The pins also serve to reinforce the packing material so as to decrease compaction of the packing material by the fluid. Preferably twenty four pins each of $\frac{1}{4}$ inch diameter are provided between each pair of adjacent plates and four of these twenty four pins are hollow so that they may accommodate the tie rods which are preferably of $\frac{1}{8}$ inch diameter.

The inner of the two tubes 46 and 48 is preferably provided with circular holes and the outer of the two tubes 46 and 48 is preferably provided with slots. The size and distribution of the holes in the inner tube 46 are chosen such as to evenly distribute the feed suspension along the length of the tube as it passes into the packing material by causing a pressure drop in the suspension. Preferably the holes occupy an area in the range from 2% to 10%, and most preferably 4% to 5%, of the total area of tube surface (including the holes). Thus the holes may be evenly distributed at a density of sixteen holes per square inch if the holes are of 1/16 inch diameter, that is with the centres of the holes spaced apart by $\frac{1}{2}$ inch. The inner tube 46, which is for example of 6 inch diameter, may be formed by bending a preformed apertured sheet. The outer tube 48, which preferably surrounds the tube 46 at a distance in the range from $\frac{1}{8}$ inch to $\frac{1}{2}$ inch, has axially extending slots which are offset radially from these apertures so as to decrease the velocity of the jets of feed suspension passing through the holes in the tube 46, thus increasing the chance of the magnetisable particles in the feed suspension being captured within the packing material. The slots may each be about $\frac{1}{8}$ inch wide and about three inches long, the centres of adjacent slots being spaced apart by about $\frac{1}{4}$ inch. The slots are arranged end to end along the length of the tube with the ends of longitudinally adjacent slots being spaced apart by about ½ inch.

The moving means is advantageously constituted by two hydraulic rams, such as 6, one disposed at either end of the train. Reciprocating movement of the train may then be achieved by alternately pulling the train with each of the rams and it is not necessary to exert a pushing force on the train which may cause the train to skate from side to side.

I claim:

1. Magnetic separating apparatus comprising:

means for establishing a magnetic field in a predetermined zone;

a separating chamber having an inlet and an outlet for a fluid which carries magnetizable particles sought to be separated by said apparatus;

fluid-permeable and magnetizable packing material disposed within the separating chamber for collecting said particles when said chamber is in said predetermined zone;

means for moving the separating chamber between said predetermined zone and a cleaning and flushing zone remote from said predetermined zone whereat magnetizable particles collected at said packing material are flushed from said material to clean some for reuse; and ferromagnetic shielding means for magnetically screening said separating chamber at said cleaning and flushing zone to facilitate said cleaning and flushing; said means comprising a continuous ferromagnetic cylinder for receiving said chamber therein, and a pair of ferromagnetic discs cooperating with and substantially closing the ends of said cylinder, to thereby substantially enclose all sides of said separating chamber when within said cleaning and flushing zone.

2. Apparatus in accordance with claim 1 wherein said separating chamber includes a ferromagnetic wall which defines at least one of said discs.

3. Apparatus in accordance with claim 2, wherein the said separating chamber is in the form of a cylinder of circular cross-section of slightly smaller diameter than the said ferromagnetic cylinder of said shielding means.

4. Apparatus in accordance with claim 1, wherein said ferromagnetic cylinder of said shielding means is constituted by two semicylindrical halves coupled together.

5. Apparatus in accordance with claim 1, wherein said separating chamber is elongate and said moving means is adapted to move said separating chamber axially between said predetermined zone and the cleaning and flushing zone.

6. Apparatus in accordance with claim 1, wherein means are provided for flushing out magnetizable particles from the separating chamber when within the cleaning and flushing zone.

7. Magnetic separating apparatus comprising:

means for establishing a magnetic field in a predetermined zone;

at least first and second separating chambers coupled together to form a train, each said chamber having an inlet and an outlet for a fluid carrying magnetizable particles to be separated at said apparatus;

magnetizable packing material permeable to said fluid being disposed within said separating chambers;

means for moving the said train between a first position in which the first of said separating chambers is within said predetermined zone whereat said packing material is magnetized and collects said particles, and the second of said separating chambers is within one of one or more cleaning zones remote from said predetermined zone whereat magnetizable particles collected at said packing material are flushed from said material to clean same for reuse, and a second position in which the second of said chambers is within said predetermined zone and said first of said chambers is within one of said one or more remote cleaning zones; and a ferromagnetic magnetic field shielding means surrounding each of said one or more remote cleaning zones for magnetically screening said separating chamber when within a said cleaning zone to thereby facilitate said flushing; said shielding means comprising a continuous ferromagnetic cylinder for surrounding said separating chamber, and a pair of cooperating ferromagnetic discs, said discs and cylinder substantially enclosing all sides of said separating chamber when within a said cleaning zone.

8. Apparatus in accordance with claim 7, including two said separating chambers and two said shielding means, said moving means being adapted to move the said train reciprocatingly between the said first and second positions.

* * * * *